United States Patent [19]

Hamar

[11] 4,233,772

[45] Nov. 18, 1980

[54] ANIMATED ILLUSTRATION FOR BOOKS AND THE LIKE

[76] Inventor: Douglas A. Hamar, 0236 SW. Palatine Hill Rd., Portland, Oreg. 97219

[21] Appl. No.: 20,757

[22] Filed: Mar. 15, 1979

[51] Int. Cl.[3] ..... A63H 33/38

[52] U.S. Cl. ..... 46/35; 40/416; 46/154; 283/63 R

[58] Field of Search ..... 46/34, 36, 37, 135 R, 46/154, 13; 35/35 E, 62; 40/411, 416; 283/63 R

[56] References Cited

U.S. PATENT DOCUMENTS

| | | | |
|---|---|---|---|
| 1,028,921 | 6/1912 | Wagner | 283/63 R |
| 1,182,077 | 5/1916 | Colucci | 46/34 |
| 1,440,487 | 1/1923 | Newell | 46/135 R |
| 1,794,466 | 3/1931 | Lowenstein | 46/34 |
| 2,655,762 | 10/1953 | Burke | 46/154 X |
| 2,725,670 | 12/1955 | Hodes | 46/154 X |
| 3,226,849 | 1/1966 | Rosen | 46/154 X |
| 3,271,884 | 9/1966 | Roberson | 35/35 E |
| 3,308,479 | 3/1967 | Sesco | 46/154 UX |
| 3,778,925 | 12/1973 | Owen | 46/13 |
| 3,918,180 | 11/1975 | Chamberlin | 46/154 X |

FOREIGN PATENT DOCUMENTS

| | | | |
|---|---|---|---|
| 2202834 | 7/1973 | Fed. Rep. of Germany | 46/154 |

OTHER PUBLICATIONS

Salisbury-"Funny Fingers" ©1971 by Western Publishing Co. Inc. (pamphlet).

*Primary Examiner*—F. Barry Shay
*Attorney, Agent, or Firm*—James D. Givnan, Jr.

[57] ABSTRACT

A pliable appendage secured to a book page, or other supporting surface, having an illustration thereon with the appendage contributing to the illustration. The appendage is of a pliable nature and shaped to permit entry of the fingertips for the purpose of manipulation to provide an animated illustration. A stiffener in the appendage contributes to lifelike movement of the appendage. The appendage is displaceable from one side of a supporting member to the other to enable use of a single appendage with two different illustrations. The appendage may be of multiple plies of fabric.

2 Claims, 5 Drawing Figures

ANIMATED ILLUSTRATION FOR BOOKS AND THE LIKE

BACKGROUND OF THE INVENTION

The present invention relates generally to an animated book page or other illustration having a manipulative member.

Books, particularly those intended for children, oftentimes include page structure providing for a three dimensional display. Typically such a display relies upon folded paper segments which are automatically positioned by turning of a page or in some instances by additional manual effort. Also in the prior art is book construction wherein a manipulated structure is slidably supported by a book cover, the structure being movable within elongate cover and page openings.

Additionally, books within the prior art, to the best of my knowledge, do not include erasable surfaces on a a page on which the reader may contribute original text to a story.

SUMMARY OF THE PRESENT INVENTION

The present invention is embodied within a pliable appendage to a book page or other illustration which appendage may be manipulated by the reader's fingers.

In the present disclosure, the appendage is embodied within a pliable structure which may be of fabric and simulating the mouth portion of a printed face. Stiffener means is provided in the appendage for the purpose of effecting both a desired contour and to facilitate manipulation of same. The appendage is desirably reversible so as to enable a second illustration on the reverse side of a book page or sheet to also utilize the appendage.

Important objects of the present invention include the provision of a pliable appendage for a book page, or the like, with the appendage being manipulated by finger action to simulate certain motions; the provision of an appendage to a book page, or the like, including a stiffener configuring the appendage so as to more closely resemble the simulated feature such as the mouth of a printed character illustration and to permit manipulation of the appendage in an animated manner; the provision of an appendage incorporated into book page structure to simulate the mouth portion of a conceptual face with the appendage being reversible for use with an illustration printed on the backside of the page or sheet; the provision of an appendage on a book page or sheet in combination with an erasable surface thereon on which may be written original text by the reader.

DETAILED DESCRIPTION OF THE PREFERRED EMBODIMENTS

Figure 1:
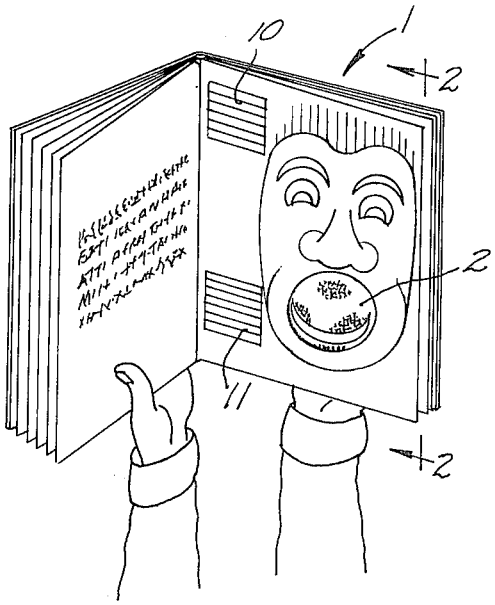
FIG. 1 is a perspective view of an illustrated sheet on which is embodied the present invention.
Figure 3:
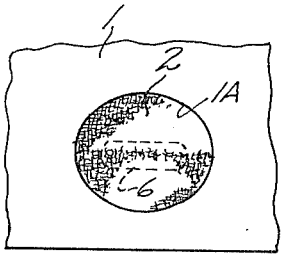
FIG. 3 is an elevational view on a reduced scale taken along line 3—3 of FIG. 2.

With continuing attention to the drawing, the reference numeral 1 indicates generally a sheet of material shown as a page of a book but which may be otherwise embodied as for example, in the form of a single sheet of a pliable or stiff nature.

Figure 2:
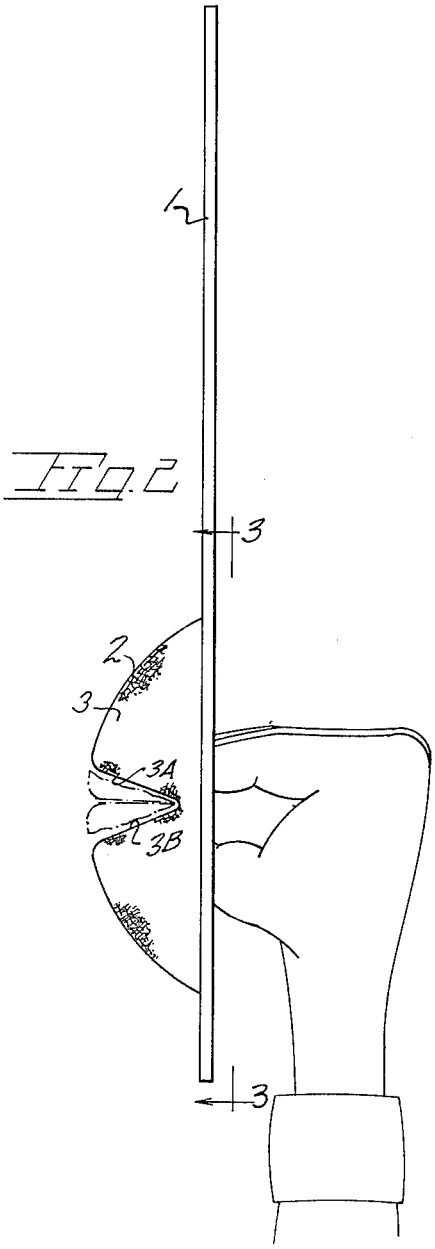
FIG. 2 is a side elevational view taken along line 2—2 of FIG. 1.

With joint attention to FIGS. 1 and 2, a pliable appendage is indicated at 2 which protrudes from its supporting sheet. In the accompanying drawing, appendage 2 constitutes the lip and mouth portions of a face imprinted on the sheet. While lip and mouth portions of the face are represented by the pliable appendage, it is to be understood that said appendage may represent various other features, human or otherwise, capable of being animated by manipulation.

Sheet 1 defines an opening 1A within which appendage 2 is supported. Desirably the appendage is of the reversible type, i.e., the same may be positioned oppositely of the sheet for use in conjunction with an illustration on the reverse side of the sheet.

The appendage is disclosed as being embodied of pliable plies 3 and 4 of material such as a woven or knitted fabric, each having a perimetrical portion at 3A and 4A for securement to sheet 1. Such securement may be by lamination with a suitable adhesive intermediate sheet members 1A and 1B. In instances where the appendage is to simulate the lips and mouth of an illustrated face, the mouth is simulated by inwardly directed portions 3A–3B the latter provided with a tongue 5.

Figure 4:
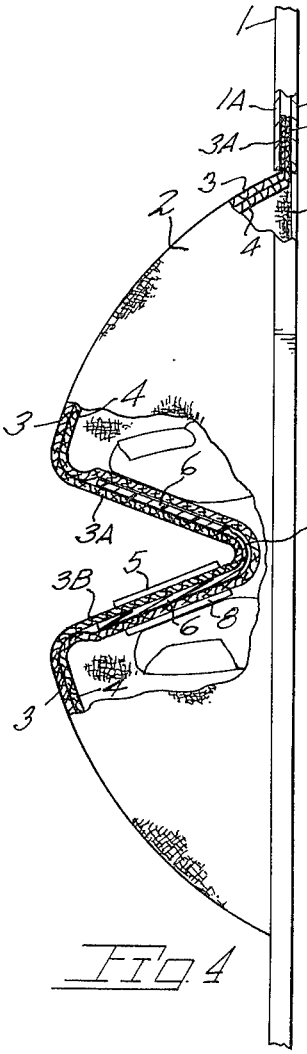
FIG. 4 is a view similar to FIG. 2 but on an enlarged scale with fragments broken away for purposes of illustration.

To facilitate manipulation, stiffener means at 6 is provided in the form of an elongate flexible member having a bendable central portion 7. Accordingly, mouth movement is simulated by closing and opening of the operator's thumb and fingers per FIGS. 4 and 5.

Figure 5:
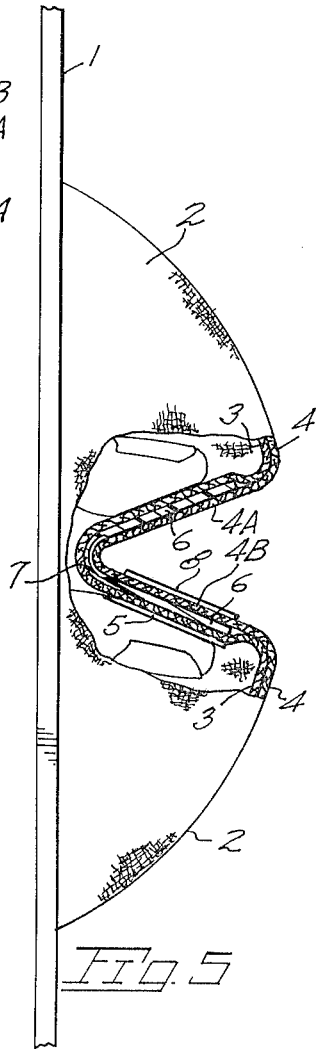
FIG. 5 is a view similar to FIG. 4 but with the pliable appendage of the present invention displaced outwardly from the opposite side of the supporting sheet.

For the purpose of enabling an appendage usable with illustrations on both sides of the sheet, the stiffener means 6 is reversible, as shown in FIG. 5, by the upper and lower portions of the stiffener means 6 being oppositely swung about flexible portion 7. To assure retention of stiffener means 6 in place, relative the plies 3 and 4, an adhesive may be used. A second tongue 8 is visible when reversed per FIG. 5 in a mouth at 4A–4B.

In one embodiment the material of the appendage is of knitted fabric providing a highly flexible mouth portion to render same extremely pliable to contribute to ease of manipulation.

In FIG. 1, sheet 1 is provided with erasable surfaces 10 and 11 which are of a pliable, synthetic nature to permit the reader to write original text to supplement the printed text of the book. Accordingly, the reader is provided both the opportunity of adding original material to the book as well as the opportunity of manipulating a portion of a book illustration in the general nature of a hand puppet.

While I have shown but one embodiment of the invention it will be apparent to those skilled in the art that the invention may be embodied still otherwise without departing from the spirit and scope of the invention.

Having thus described the invention, what is claimed and desired to be secured under a Letters Patent is:

1. In combination, a sheet having a printed illustration thereon and defining an open area, a pliable appendage secured to said sheet in overlying relationship to the open area and contributing visually to the illustration, said appendage including stiffener means to facilitate manipulation of said appendage, said open area being of sufficient size to permit manipulation of said appendage by insertion of fingers of the user through said open area into said appendage, said appendage and stiffener means displaceable through the open area to either of the two sides of the sheet to permit the appendage to be used in conjunction with an illustration on the opposite side of the sheet, said stiffener means having a bendable central portion.

2. The invention claimed in claim 1 wherein the appendage is formed from multiple plies of fabric with said stiffener means in place therebetween.

* * * * *